US005380693A

United States Patent [19]

Goto

[11] Patent Number: 5,380,693

[45] Date of Patent: Jan. 10, 1995

[54] TRANSPARENT THERMOSENSITIVE RECORDING MEDIUM

[75] Inventor: Hiroshi Goto, Fuji, Japan

[73] Assignee: Ricoh Company, Ltd., Tokyo, Japan

[21] Appl. No.: 221,669

[22] Filed: Apr. 1, 1994

[30] Foreign Application Priority Data

| | | | |
|---|---|---|---|
| Apr. 2, 1993 | [JP] | Japan | 5-100565 |
| Jun. 29, 1993 | [JP] | Japan | 5-185454 |
| Oct. 12, 1993 | [JP] | Japan | 5-280173 |
| Oct. 12, 1993 | [JP] | Japan | 5-280174 |

[51] Int. Cl.[6] ..... B41M 5/40

[52] U.S. Cl. ..... 503/200; 427/152; 428/212; 503/214; 503/216; 503/226

[58] Field of Search ..... 427/152; 428/212, 913; 503/200, 226, 214, 216

[56] References Cited

U.S. PATENT DOCUMENTS

| | | | |
|---|---|---|---|
| 5,256,619 | 10/1993 | Yoshida et al. | 503/226 |
| 5,296,439 | 3/1994 | Maruyama et al. | 503/201 |

*Primary Examiner*—B. Hamilton Hess

*Attorney, Agent, or Firm*—Oblon, Spivak, McClelland, Maier, & Neustadt

[57] ABSTRACT

A transparent thermosensitive recording medium includes a transparent support, a thermosensitive recording layer which contains an electron-donating coloring compound, an electron-accepting compound and a binder resin, formed on the transparent support, and a protective layer formed on the thermosensitive recording layer, with the transparent support, the thermosensitive recording layer and the protective layer having substantially the same refractive index.

6 Claims, 3 Drawing Sheets

TRANSPARENT THERMOSENSITIVE RECORDING MEDIUM

BACKGROUND OF THE INVENTION

1. Field of the Invention

The present invention relates to a thermosensitive recording medium which utilizes a coloring reaction between an electron-donating coloring compound and an electron-accepting compound, more particularly to a transparent thermosensitive recording medium which utilizes the above-mentioned coloring reaction, which can be used as an image formation film sheet for overhead projectors (hereinafter referred to as OHP) and for CAD.

2. Discussion of Background

Thermosensitive recording media which utilize a coloring reaction between an electron-donating coloring compound (hereinafter referred to as a coloring agent) and an electron-accepting compound (hereinafter referred to as a color developer) are widely known and used.

In recent years, there is a demand for a thermosensitive recording medium for use in a large size overhead projector and for use as a second original for diazo copying, and for preparing design drawings.

Transparent thermosensitive recording media on which recording can be directly made thereon by a thermal head have been proposed in Japanese Patent Application 61-121875 and Japanese Laid-Open Patent Application 1-99873.

These transparent thermosensitive recording media have the shortcomings that for the production thereof, there are required complicated steps such as microcapsulizing a coloring agent, coating a transparent support with an emulsion dispersion which is prepared by emulsifying a color developer in an organic solvent which is insoluble or slightly soluble in water, and that the transparency of the recording media is not sufficient for use in practice.

SUMMARY OF THE INVENTION

It is therefore an object of the present invention to provide a transparent thermosensitive recording medium which utilizes a coloring reaction between a coloring agent and a color developer, can be produced easily, and has excellent transparency, from which the shortcomings of the conventional transparent thermosensitive recording media have been eliminated.

This object of the present invention can be achieved by a transparent thermosensitive recording medium which comprises (a) a transparent support, (b) a thermosensitive recording layer comprising an electron-donating coloring compound, an electron-accepting compound and a binder resin, formed on the transparent support, and (c) a protective layer formed on the thermosensitive recording layer, with the transparent support, the thermosensitive recording layer and the protective layer having substantially the same refractive index.

It is preferable that the refractive index of the binder resin contained in the thermosensitive recording layer be in the range of 1.45 to 1.60.

Furthermore, it is preferable that the electron-accepting compound contained in the thermosensitive recording layer be an organic phosphoric acid compound of the following formula (I) or formula (II):

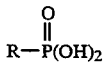

(I)

wherein R is a straight-chain alkyl group having 16 to 24 carbon atoms.

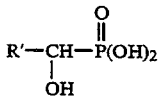

(II)

wherein R′ is a straight-chain alkyl group having 13 to 23 carbon atoms.

Furthermore, it is preferable that the binder resin contained in the thermosensitive recording layer be a binder resin including a hydroxyl group in the molecule thereof.

The transparent thermosensitive recording medium of the present invention can be modified in such a manner that a first thermosensitive recording layer comprising and a protective layer are successively formed on one side of the support, and a second thermosensitive recording layer comprising an electron-donating compound, an electron-accepting compound and a binder resin, and a protective layer are successively formed on the other side of the support. In this transparent thermosensitive recording medium, the refractive indexes of the transparent support, the two thermosensitive recording layers and protective layers are preferably substantially the same, and each of the two recording layers may be capable of producing a different color from the color produced by the other recording layer.

DESCRIPTION OF THE PREFERRED EMBODIMENTS

Figure 1:
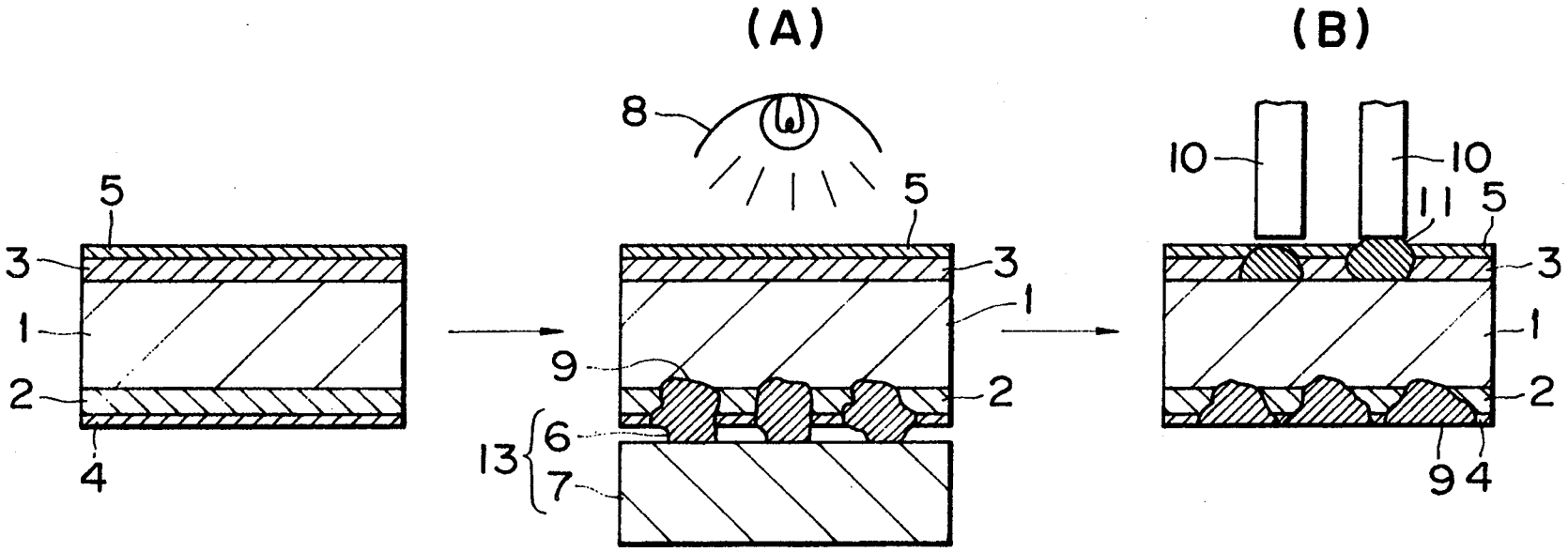
FIG. 1 is a schematic diagram for illustrating a method of forming two-colored images by use of a transparent thermosensitive recording medium of the present invention.

In the transparent thermosensitive recording medium of the present invention, which comprises (a) a transparent support, (b) a thermosensitive recording layer comprising an electron-donating coloring compound, an electron-accepting compound and a binder resin, formed on the transparent support, and (c) a protective layer formed on the thermosensitive recording layer, with the transparent support, the thermosensitive recording layer and the protective layer having substantially the same refractive index, it is preferable that one or more kinds of light stabilizing agents be contained in the thermosensitive recording layer or in the protective layer in order to significantly improve the light resistance of image areas and background areas of the recording medium.

Furthermore, by containing a lubricant in the protective layer, a transparent thermosensitive recording medium with excellent head-matching properties, free from the problem of sticking a thermal head to the recording medium, can be obtained.

The coloring agent for use in the present invention is a colorless or light-colored dye precursor and is not limited to a particular coloring agent, but conventional coloring agents such as triphenyl methane phthalide compounds, fluoran compounds, phenothiazine compounds, Leuco-Auramine compounds, spiropyran compounds, and indophthalide compounds can be employed.

A preferable coloring agent for use in the present invention is a fluoran compound.

Specific example of the fluoran compound for use in the present invention are as follows:

3,6-dimethoxyfluoran,
3-cyclohexylamino-6-chlorofluoran,
3-dimethylamino-5,7-dimethylfluoran,
3-diethylamino-5,7-dimethylfluoran,
3-dimethylamino-7-chlorofluoran,
3-diethylamino-7-chlorofluoran,
3-dimethylamino-7-methylfluoran,
3-diethylamino-7-methylfluoran,
3diethylamino-6-methyl-7-chlorofluoran,
3-diethylamino-6-methyl-7-bromofluoran,
3-di-n-butylamino-6-methyl-7-bromofluoran,
3-diethylamino-6-methyl-8-methylfluoran,
3-di-n-butylamino-6-methyl-8-methylfluoran,
3-diethylamino-7,8-benzofluoran,
3-di-n-butylamino-7,8-benzofluoran,
3-(N-n-butyl-N-methylamino)-7,8-bonzofluoran,
3-(N-n-butyl-N-ethylamino)-7,8-benzofluoran,
3-(N-iso-butyl-N-ethylamino)-7,8-benzofluoran,
3-di-iso-butylamino-7,8-benzofluoran,
3-(N-iso-amyl-N-ethylamino)-7,8-benzofluoran,
3,6-bis(diphenylamino)fluoran,
3,6-bis(N-biphenyl-N-phenylamino)fluoran,
3-diethylamino-7-anilinofluoran,
3-di-n-butylamino-7-anilinofluoran,
3-(N-n-hexyl-N-ethylamino)-7-anilinofluoran,
3-diethylamino-7-dibenzylaminofluoran,
3-diethylamino-5-methyl-7-dibenzylaminofluoran,
3-diethylamino-7-piperidinofluoran,
3-diethylamino-7-(o-chloroanilino)fluoran,
3-di-n-butylamino-7-(o-chloroanilino)fluoran,
3-dimethylamino-6-methyl-7-anilinofluoran,
3-diethylamino-6-methyl-7-anilinofluoran,
3-di-n-butylamino-6-methyl-7-anilinofluoran,
3-(N-n-propyl-N-methylamino)-6-methyl-7-anilinofluoran,
3-(N-iso-propyl-N-methylamino)-6-methyl-7-anilinofluoran,
3-(N-n-butyl-N-ethylamino)-6-methyl-7-anilinofluoran,
3-(N-iso-butyl-N-methylamino)-6-methyl-7-anilinofluoran,
3-(N-n-amyl-N-methylamino)-6-methyl-7-anilinofluoran,
3-(N-iso-amyl-N-ethylamino)-6-methyl-7-anilinofluoran,
3-(N-cyclohexyl-N-methyl)-6-methyl-7-anilinofluoran,
3-(N-n-amyl-N-ethylamino)-6-methyl-7-anilinofluoran,
3-(N-p-tolyl-N-ethylamino)-6-methyl-7-anilinofluoran,
3-(N-2-ethoxypropyl-N-ethylamino)-6-methyl-7-anilinofluoran,
3-pyrrolidino-6-methyl-7-anilinofluoran,
3-(N-tetrahydrofurfuryl-N-ethylamino)-6-methyl-7-anilinofluoran,
3-diethylamino-7-(m-trifluoromethylanilino)fluoran,
3-diethylamino-6-methyl-7-(2',4'-dimethylanilino)-fluoran,
3-diethylamino-6-chloro-7-anilinofluoran,
3-diethylamino-5-methyl-7-(α-phenylethylamino)-fluoran, and
3-(N-p-tolyl-N-ethylamino)-7-(α-phenylethylamino)-fluoran.

In the present invention, as the color developer for inducing color formation in the above-mentioned coloring agents, phenolic compounds and organic phosphoric acid compounds which are insoluble or slightly soluble in solvents in general use are preferable. Of these compounds, organic phosphoric acid compounds are more suitable for use in the present invention because the fogging of the background of images can be reduced and the thermal sensitivity of the recording medium can be improved.

Specific examples of the phenolic compounds include gallic acid compounds, protocatechuic acid compounds, and bis(hydroxyphenyl)acetic acid compounds.

Specific examples of the organic phosphoric acid compounds include alkylphosphonic acid compounds, and α-hydroxyalkylphosphonic acid compounds.

In particular, the phosphonic acid compounds of the following formula (I) and formula (II) are preferable for use in the present invention:

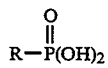

(I)

wherein R is a straight-chain alkyl group having 16 to 24 carbon atoms.

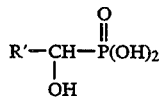

(II)

wherein R' is a straight-chain alkyl group having 13 to 23 carbon atoms.

Specific examples of the phosphonic acid of formula (I) include hexadecylphosphonic acid, octadecylphosphonic acid, eicosylphosphonic acid, docosylphosphonic acid and tetracosylphosphonic acid.

Specific examples of the phosphonic acid of formula (II) include α-hydroxytetradecyl phosphonic acid, α-hydroxyhexadecyl phosphonic acid, α-hydroxyoctadecyl phosphonic acid, α-hydroxyeicosyl phosphonic acid, and α-hydroxytetracosyl phosphonic acid.

In the present invention, the above-mentioned color developers can be used alone or in combination, and the coloring agents can also be used alone or in combination.

For the improvement of the thermal sensitivity and resolution of the transparent thermosensitive recording medium of the present invention, it is preferable that the color developer be in the form of finely-divided particles with an average particle size of 10 μm or less, more preferably in the range of 1 μm or less, and that the color developer with a particle size of 1 μm or more be not included.

It is preferable that the binder agent for use in the present invention have a refractive index in the range of 1.45 to 1.60 at room temperature.

Specific examples of such a binder agent include phenolic resin (1.50–1.60), urea resin (1.54–1.56), epoxy resin (1.55–1.61), polyester resin (1.52–1.57), polyvinyl chloride resin (1.52–1.55), polystyrene (1.59–1.60), styrene-acrylonitrile copolymer resin (1.56–1.57), acrylic resin (1.45–1.60), polycarbonate (1.58–1.59), polyacetal (1.48–1.50), polyamide (1.52–1.53), polyurethane (1.50–1.60), alkyl cellulose (1.46–1.55), cellulose acetate (1.46–1.50), cellulose acetate butyrate (1.46–1.49), cellulose acetate propionate (1.46–1.49), and nitrocellulose (1.49–1.51).

Of the above-mentioned binder resins, such binder resins that include a hydroxyl group in the molecule thereof are more preferable for use in the present invention.

Specific examples of such binder resins include polyvinyl butyral (1.48–1.49), polyvinyl acetal (1.50), epoxy resin (1.55–1.61), ethyl cellulose (1.46–1.49), cellulose acetate (1.46–1.50), cellulose acetate butyrate (1.46–1.49), cellulose acetate propionate (1.46–1.49), and nitrocellulose (1.49–1.51).

It is preferable that the support for the transparent thermosensitive recording medium of the present invention have a refractive index of 1.45 to 1.60 at room temperature.

Specific examples of the support include films of polyesters such as polyethylene terephthalate, and polybutylene terephthalate; films of cellulose derivatives such as triacetic acid cellulose; films of polyolefins such as polypropylene and polyethylene; and a polystyrene film. A laminated transparent support fabricated by laminating any of the above-mentioned films is more preferably employed in the present invention.

It is preferable that an adhesive layer be provided between the thermosensitive recording layer and the transparent support in practice.

Examples of the material for such an adhesive layer include acrylic resin, saturated polyester resin, and materials prepared by curing any of these resins.

The thermosensitive recording layer for the transparent thermosensitive recording medium of the present invention contains finely-divided particles of a color developer which are dispersed in a binder resin, and minutes voids are also contained in the thermosensitive recording layer. Because of the presence of such finely-divided particles and voids in the surface portion and inner portion of the thermosensitive recording layer, the surface of the thermosensitive recording layer is not smooth, and the refractive index of the thermosensitive recording layer is not constant throughout the recording layer. As a result, light scattering takes place in the thermosensitive recording layer so that the thermosensitive recording layer is opaque.

When a resin having the same refractive index as that of the binder resin employed in the thermosensitive recording layer at room temperature is uniformly coated on such an opaque thermosensitive recording layer, dried or cured, a thermosensitive recording layer which is free from the voids and has a smooth surface and therefore has substantially no light scattering and is transparent can be obtained.

Such a protective layer composed of the above-mentioned resin not only makes the thermosensitive recording layer transparent, but also improves the resistance of the thermosensitive recording layer to chemicals, water, abrasion and light, and the head-matching properties of the thermosensitive recording layer, so that such a protective layer is an indispensable element for constructing a transparent thermosensitive recording medium with high performance.

Examples of such a protective layer for use in the present invention include a film which is mainly composed of a water-soluble resin or a hydrophobic resin, and a film which is mainly composed of an ultraviolet curing resin or an electron-beam curing resin.

By the provision of such a protective layer on the thermosensitive recording layer, there can be obtained a transparent thermosensitive recording medium which is not affected even if it comes into contact with organic solvents, plasticizers, oils, sweat, water and the like.

Furthermore by containing an organic or inorganic filler in the protective layer, a transparent thermosensitive recording medium with excellent head-matching properties, free from the problem of the sticking of the recording medium to a thermal head, and therefore with high performance reliability, can be obtained.

It is preferable that the resin for use in the protective layer be a binder resin with a refractive index of 1.45 to 1.60.

Examples of such a binder resin include a water-soluble resin, a resin for an aqueous emulsion, an ultraviolet curing resin, and an electron-beam curing resin.

Specific examples of the water-soluble resin include polyvinyl alcohol, modified polyvinyl alcohol, cellulose derivatives such as methyl cellulose, methoxy cellulose, hydroxyethyl cellulose, casein, gelatin, polyvinyl pyrrolidone, styrene-maleic anhydride copolymer, diisobutylene-maleic anhydride copolymer, polyacrylamide, modified polyacrylamide, methyl vinyl ether-maleic anhydride copolymer, carboxy-modified polyethylene, polyvinyl alcohol-acrylamide block copolymer, melamine-formaldehyde resin, and urea-formaldehyde resin.

Specific examples of the resin for aqueous emulsion or the hydrophobic resin include polyvinyl acetate, polyurethane, styrene-butadiene copolymer, styrene-butadiene-acryl copolymer, polyacrylic acid, polyacrylic ester, vinyl chloride-vinyl acetate copolymer, polybutyl methacrylate, and ethylene-vinyl acetate copolymer. These resins can be used alone or in combination. When necessary, a curing agent may be added to these resins to cure the resins.

An ultraviolet curing resin and an electron-beam curing resin which are most preferable for use in the protective layer will now be explained in detail.

The ultraviolet curing resin is prepared by polymerizing a monomer or oligomer (or prepolymer) which is polymerizable to form a cured resin by the application of ultraviolet light thereto. There are no limitations on such a monomer or oligomer (or prepolymer) for the preparation of the ultraviolet curing resin for use in the protective layer, but conventional monomers and oligomers (or prepolymers) can be employed.

Specific examples of such a monomer or oligomer include (poly)ester acrylate, (poly)urethane acrylate, epoxy acrylate, polybutadiene acrylate, and silicone acrylate; and melamine acrylate.

The (poly)ester acrylate is prepared by allowing a polyhydric alcohol such as 1,6-hexadiol, propylene glycol (in the form of propylene oxide), and diethylene glycol, and a polybasic acid such as adipic acid, phthalic anhydride, trimellitic acid to react with acrylic acid.

The following are the examples of the structure of the (poly)ester acrylate:

(a) Adipic acid/1,6-hexanediol/acrylic acid $CH_2{=}CHCOO\text{-}(CH_2)_6[O{-}CO{-}(CH_2)_4COO\text{-}(CH_2)_6]_nOCOCH{=}CH_2$ wherein n is an integer of 1 to 10.

(b) Phthalic anhydride/propylene oxide/acrylic acid

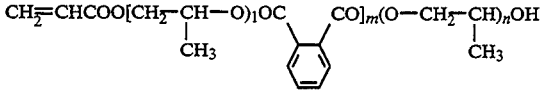

wherein l is an integer of 1 to 10, m is an integer of 1 to 10, and n is an integer of 1 to 10.

(c) Trimellitic acid/diethylene glycol/acrylic acid

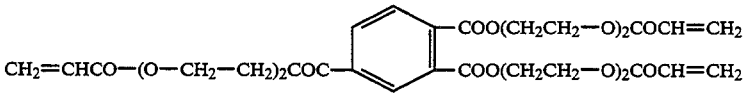

The (poly)urethane acrylate is prepared by allowing a compound having an isocyanate group, such as tolylene diisocyanate (TDI) to react with an acylate having a hydroxyl group.

The structure of the (poly)urethane acrylate is: HEA/TDI/HDO/ADA/HDO/TDI/HEA, wherein HEA is 2-hydroxyethyl acrylate, HDO is 1,6-hexanediol, and ADA is adipic acid.

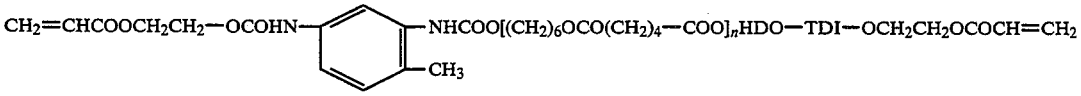

wherein n is an integer of 1 to 10.

Epoxy acrylate can be roughly classified into a bisphenol A type, a novolak type, and an alicyclic type. The epoxy group of these epoxy resins is esterified with acrylic acid to convert it to an acryloyl group.

Examples of the structure of epoxy acrylate are as follows:

(e) Bisphenol A - epichlorohydrin type/acrylic acid

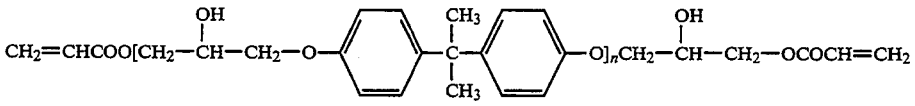

wherein n is an integer of 1 to 15.

(f) Phenolic novolak - epichlorohydrin type/acrylic acid

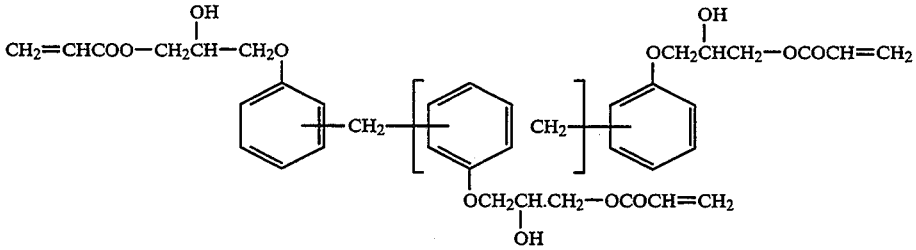

wherein n is an integer of 0 to 5.

(g) Alicyclic/acrylic acid

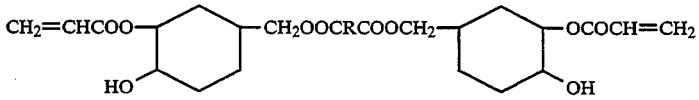

wherein R is $-(CH_2)_n-$, and n is an integer of 1 to 10.

The polybutadiene acrylate is prepared by allowing isocyanate or 1,2-mercaptoethanol to react with a terminal hydroxyl group containing 1,2-butadiene to obtain a reaction product, and then by allowing the reaction product to react with acrylic acid or the like.

An example of the structure of the polybutadiene acrylate is as follows:

(h) Polybutadiene acrylate

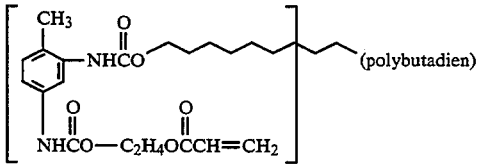

The silicone acrylate is obtained by methacryl modification which is conducted, for example, by a condensation reaction (methanol elimination reaction) between an organic functional trimethoxy silane and a silanol-group containing polysiloxane.

An example of the structure of the silicone acrylate is as follows:

(i) Silicone acrylate

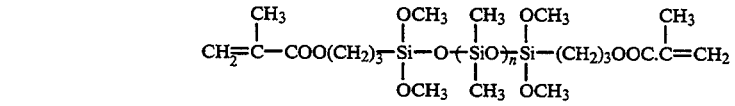

wherein n is an integer of 10 to 14.

When an ultraviolet curing resin is employed, there is the case where a solvent is used. Examples of such a solvent are organic solvents such as tetrahydrofuran, methyl ethyl ketone, methyl isobutyl ketone, chloroform, carbon tetrachloride, ethanol, isopropyl alcohol, ethyl acetate, butyl acetate, toluene and benzene.

Instead of these organic solvents, a photopolymerizable monomer may be employed as a reactive diluent to make the handling easy.

Specific examples of the photopolymerizable monomer include 2-ethylhexyl acrylate, cyclohexyl acrylate, butoxyethyl acrylate, neopentyl glycol diacrylate, 1,6-hexane diol diacrylate, polyethylene glycol diacrylate, trimethylolpropane triacrylate, and pentaerythritol triacrylate.

There are no particular limitations on the electron-beam curing resins for use in the present invention. Particularly preferable electron-beam curing resins for use in the present invention are an electron-beam curing resin comprising a polyester skeleton with a five or more functional branched molecular structure (hereinafter referred to as the electron-beam curing acryl-modified polyurethane resin) and a resin comprising as the main component a silicone-modified electro-beam curing resin.

The electron-beam curing acryl-modified polyurethane resin can be produced, for example, by allowing diisocyanate and a compound having an acrylic double bond to react with a mixture of a polyester diol and polyether triol of a reaction produce of 1,4-butane diol and adipic acid, or of a reaction product of propylene glycol and adipic acid, which corresponds to the polyester skeleton moiety.

Instead of the mixture of the polyester diol and polyether triol, for example, a mixture of a polyether diol and a polyether triol, a mixture of a polyester diol and a polyester triol, and a mixture of a polyether diol and a polyester triol can be employed.

Specific examples of the diisocyanate include 2,4-tolylene diisocyanate, 2,6-tolylene diisocyanate, 1,6-hexamethylene diisocyanate, xylylene diisocyanate, isophorone diisocyanate, and methylenebis (4-phenyl isocyanate).

Specific examples of the compound having an acrylic double bond include 2-hydroxyethyl (meth)acrylate, 2-hydroxypropyl (meth)acrylate, and 3-hydroxypropyl (meth) acrylate.

Polyester diol is commercially available under the trademark "Adeka New Ace Y4–30" (made by Asahi Denka Kogyo K.K.) and polyether triol is also commerically available under the trademarks "Sannix TP-400" and "Sannix GP-3000" (made by Sanyo Chemical Industries, Ltd.).

It is preferable that the molecular weight of the polyester moiety of this electron-beam curing acryl-modified polyurethane resin be in the range of 2,000 to 4,000 for imparting flexibility and toughness to the protective layer which also serves as a heat-resistant slip layer.

It is also preferable that the molecular weight of the electron-beam curing acryl-modified polyurethane resin be in the range of 20,000 to 50,000 for imparting flexibility and toughness to the protective layer.

Furthermore, the curing speed and the hardness of the electron-beam curing acryl-modified polyurethane resin can be increased when five or more functional groups, preferably 7 to 13 functional groups, are included in this resin.

The silicone-modified electron-beam curing resin has the following formula:

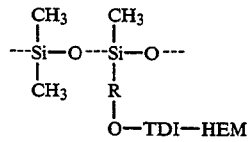

wherein R is $-(CH_2)_n-$, in which n is an integer of 0 to 3, TDI is 2,4-tolylenediisocyanate, and HEM is 2-hydroxyethyl acrylate.

Since this silicone-modified electron-beam curing resin has excellent filming and coating properties, a uniformly thin film can be formed by this resin. Furthermore, since this resin has silicone functional groups, it has excellent slipping effect.

When the electron-beam curing acryl-modified polyurethane resin and the electron-beam curing silicone-modified resin are used in combination, it is preferable that the amount of the electron-beam curing silicone-modified resin be at most 30 parts by weight, more preferably in the range of 5 to 20 parts by weight, to 100 parts by weight of the electron-beam curing acryl-modified polyurethane resin.

It is preferable that the protective layer for use in the present invention be fabricated by use of a polyfunctional electron-beam curing monomer in combination with electron-beam curing monomers in order to promote the curing of the protective layer, and to improve the heat resistant effect of the protective layer.

Such a polyfunctional electron-beam curing monomer serves as a cross-linking promoting agent and is useful for forming a complicated, high density cross-linking structure.

Specific examples of the polyfunctional electron-beam curing monomer include trimethylolpropane triacrylate, tetramethylolmethane tetracrylate, pentaerythritol triacrylate, and dipentaerythritol triacrylate.

It is preferable that such a monomer be added in an amount in the range of 50 parts by weight at most, more preferably in the range of 20 to 50 parts by weight, to 100 parts by weight of the electron-beam curing acryl-modified polyurethane resin. When the amount of the monomer exceeds 50 parts by weight, the slipping effect tends to be decreased.

A protective layer composed of a phosphazene resin can also be employed in the present invention. The phosphasene resin contains a phosphazene skeleton as a repeat unit of the following formula and has excellent heat resistance:

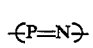

A specific example of the phosphasene resin is represented by the following formula (A):

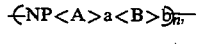

wherein a and b are real numbers which satisfy the conditions, $a>0$, $b\geqq 0$, and $a+b=2$; and A is a polymerizable curing group of the following formula, such as a methacryloyloxyethyl group:

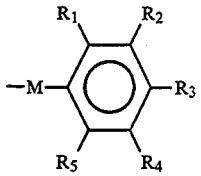

wherein $R^1$ to $R^5$ are independently a hydrogen atom, a chlorine atom, a bromine atom, or a halogenated alkyl group having 1 to 4 carbon atoms; and M is an oxygen atom, a sulfur atom, or an imino group.

A phosphazene resin of the above formula (A), in which A is a methacryloyloxyethyl group, and b is zero, can be produced by ring-opening-polymerization of a compound of the following formula (B):

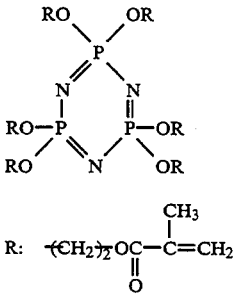

When a resin having polymerizable curing groups as in the case of the phosphazene resin of the formula (A) is employed for the protective layer, the mechanical strength, hardness and heat resistance of the protective layer can be improved by curing the resin with the application of ultraviolet light, electron beams, or heat.

The light resistance of the transparent thermosensitive recording medium of the present invention can be improved by containing a light stabilizing agent in the thermosensitive recording layer or in the protective layer. Specific examples of a light stabilizing agent for use in the present invention include an ultraviolet absorbing agent, an antioxidant, an anti-aging agent, a singlet oxygen extinction agent, and a superoxide anion extinction agent.

Specific examples of the ultraviolet absorbing agent are as follows:

(1) Benzophenone ultraviolet absorbing agents:
2,4-dihydroxybenzophenone,
2-hydroxy-4-methoxybenzophenone,
2-hydroxy-4-n-octoxybenzophenone,
4-dodecyloxy-2-hydroxybenzophenone,
2,2'-dihydroxy-4-methoxybenzophenone,
2,2'-dihydroxy-4,4'-dimethoxybenzophenone,
2,2',1,4'-tetrahydroxybenzophenone,
2-hydroxy-4-methoxy-2'-carboxybenzophenone,
2-hydroxy-4-oxybenzylbenzophenone,
2-hydroxy-4-chlorobenzophenone,
2-hydroxy-5-chlorobenzophenone,
2-hydroxy-4-methoxy-4'-methylbenzophenone,
2-hydroxy-4-n-heptoxybenzophenone,
2-hydroxy-3,6-dichloro-4-methoxybenzophenone,
2-hydroxy-3,6-dichloro-4-ethoxybenzophenone, and
2-hydroxy-4-(2-hydroxy-3-methylacryloxy)propoxybenzophenone.

(2) Benzotriazole ultraviolet absorbing agents:
2-(2-hydroxy-5'-methylphenyl)benzotriazole,
2-(2'-hydroxy-3',5'-di-tert-butylphenyl)-benzotriazole,
2-(2'-hydroxy-3'-tert-butyl-5'-methylphenyl)-benzotriazole,
2-(2'-hydroxy-4'-octoxy)benzotriazole,
2-(2'-hydroxy-3',5'-di-tert-butylphenyl)-5-chlorobenzotriazole,
2-(3'-tert-butyl-2'-hydroxy-5'-methylphenyl)-5-chlorobenzotriazole, and
2-(2'-hydroxy-5-ethoxyphenyl)benzotriazole.

(3) Phenyl salicylate ultraviolet absorbing agents:
phenyl salicylate,
p-octylphenyl salicylate,
p-tert-butylphenyl salicylate,
carboxyphenyl salicylate,
methylphenyl salicylate, and
dodecylphenyl salicylate.

(4) Other ultraviolet absorbing agents:
p-methoxybenzylidene malonic acid dimethyl ester,
2-ethylhexyl-2-cyano-3,3'-diphenyl acrylate,
ethyl-2-cyano-3,3'-diphenyl acrylate, and
3,5-di-tert-butyl-p-hydroxybenzoic acid.

(5) Ultraviolet absorbing agents which undergo rearrangements to benzophenone:
resorcinol monobenzoate,
2,4-di-tert-butylphenyl, and
3,5-di-tert-butyl-4-hydroxybenzoate.

Specific examples of the antioxidant and anti-aging agent are as follows:
2,6-di-tert-butyl-4-methylphenol,
2,4,6-tri-tert-butylphenol,
styrenated phenol,
2,2'-methylenebis(4-methyl-6-tert-butylphenol),
4,4'-isopropylidenebisphenol,
2,6-bis(2'-hydroxy-3'-tert-butyl-5'-methylbenzyl)-4-methylphenol,
4,4'-thiobis-(3-methyl-6-tert-butylphenol),
tetrakis-[methylene(3,5-di-tert-butyl-4-hydroxyhydrocinnamate)]methane,
p-hydroxyphenyl-3-naphthylamine,
2,2,4-trimethyl-1,2-dihydroquinoline,
thiobis($\beta$-naphtol),
mercaptobenzothiazole,
mercaptobenzimidazole,
aldol-2-naphthylamine,
bis(2,2,6,6-tetramethyl-4-piperidylbenzoate)sebacate,
2,2,6,6-tetramethyl-4-piperidylbenzoate,
dilauryl-3,3'-thiodipropionate,
distearyl-3,3'-thiodipropionate, and
tris(4-nonylphenol)phosphite.

Examples of the singlet oxygen extinction agent are carotene compounds, dyes, amine compounds, phenol compounds, nickel complexes, and sulfide compounds.

Specific examples of such singlet oxygen extinction agents include:
1,4-diazacyclo(2,2,2)octane,
$\beta$-carotene,
1,3-cyclohexadiene,
2-diethylaminomethylfuran,
2-phenylaminomethylfuran,
9-diethylaminomethylanthracene,
5-diethylaminomethyl-6-phenyl-3,4-dihydroxypyran,
nickel dimethyl dithiocarbamate,
nickel dibutyl dithiocarbamate, nickel 3,5-di-t-butyl-4-hydroxybenzyl-o-ethylphosphonate,
nickel 3,5-di-t-butyl-4-hydroxybenzyl-o-butylphosphonate,
nickel [2,2'-thiobis(4-t-octylphenolate)](n-butylamine),
nickel [2,2'-thiobis(4-t-octylphenolate)](2-ethylhexylamine),
nickel bis[2,2'-thiobis(4-t-octylphenolate)],
nickel bis[2,2'-sulfonebis(4-octylphenolate)],
nickel bis(2-hydroxy-5-methoxyphenyl-N-n-butylaldoimine,
nickel bis(dithiobenzyl), and
nickel bis(dithioacetyl).

Specific examples of the superoxide anion extinction agent are complexes of superoxide dismtase and cobalt [III] and nickel [II].

The above-mentioned agents can be used alone or in combination.

The head-matching performance of the transparent thermosensitive recording medium of the present invention can be improved by adding an organic or inorganic filler and a lubricant additive to the protective layer to such an extent that the transparency thereof is not impaired by the addition of such filler and additive.

Specific examples of the organic filler for use in the present invention include polyolefin particles, polystyrene particles, urea - formaldehyde resin particles, and fine spherical void plastics particles.

Specific examples of the inorganic filler for use in the present invention include aluminum hydroxide, calcium carbonate (ground limestone and light-duty limestone), zinc oxide, titanium oxide, barium sulfate, silica gel, colloidal silica (10–50 m μm), alumina sol (10–200 m μm), activated clay, talc, clay titanium white, kaolinite, calcined kaolinite, diatomaceous earth, synthetic kaolinite, zirconium compound, fine spherical void glass particles.

Of these fillers, spherical, lubricant fillers made of silicone resin or fluoroplastics are preferable for use in the present invention.

Examples of the lubricant additive include lubricants such as silicone oil, surfactants, organic salts, and waxes; and lubricant fillers.

Specific examples of silicone oil include dimethyl polysiloxane, methylphenyl polysiloxane, methylhydro dienepolysiloxane, alkyl-modified polysiloxane, aminomodified polysiloxane, carboxyl-modified polysiloxane, and alcohol-modified polysiloxane.

Examples of surfactants include carboxylic acid salts, sulfuric acid ester salts of higher alcohols, sulfonic acid salts, and phosphoric acid esters of higher alcohols and salts thereof.

Specific examples of the above compounds include sodium laurate, sodium stearate, sodium oleate, sodium sulfuric acid ester of lauryl alcohol, sodium sulfuric acid ester of myristyl alcohol, sodium sulfuric acid ester of cetyl alcohol, sodium sulfuric acid ester of stearyl alcohol, sodium sulfuric acid ester of oleyl alcohol, sodium sulfuric acid ester of an ethylene oxide adduct of higher alcohol, sodium octyl sulfonate, sodium decyl sulfonate, sodium dodecyl sulfonate, sodium octyl benzenesulfonate, sodium dodecyl benzenesulfonate, potassium dodecyl benzenesulfonate, sodium nonyl naphthalenesulfonate, sodium dodecylnaphthalene-sulfonate, potassium dodecyl naphthalenesulfonate, sodium salt of N-oleoyl-N-methyltaurine, esters of tetraethoxylauryl alcohol, sodium monostearyl phosphate, and sodium distearyl phosphate.

Specific examples of the salts of organic acids include metal sops such as zinc stearate, aluminum stearate, calcium stearate, and magnesium stearate; and salts such as hexyl ammonium chloride, sodium sulfosalicylate, sodium succinate, potassium succinate, potassium benzoate, and potassium adipate.

Specific examples of the waxes are natural waxes such as candelilla wax, carnauba wax, rice wax, bees wax, hydrous lanolin wax, montan wax, paraffin wax, and microcrystalline wax; and synthetic waxes such as polyethylene wax, hardened castor oil or hardened castor oil derivatives, and fatty acid amides.

It is preferable that the amount of such a lubricant in the protective layer be in the range of 0.001 to 15.0 wt. % of the entire weight of the protective layer to obtain a protective layer with appropriate mechanical strength and lubricating properties.

The transparent thermosensitive recording medium of the present invention can be produced by coating a thermosensitive recording layer formation liquid on a transparent support and drying the coated liquid to form a thermosensitive recording layer on the transparent support.

The above thermosensitive recording layer coating liquid can be prepared by any of the following three methods:

In one method, only a color developer is uniformly dispersed in an organic solvent, and then a coloring agent and a binder resin are then successively mixed with the above mixture.

In another method, a color developer is uniformly dispersed in a binder resin solution in which a binder resin is dissolved in an organic solvent, and a coloring agent is then uniformly mixed with the above mixture.

In a further method, a coloring agent, a color developer and a binder agent are uniformly dispersed in an organic solvent.

Furthermore, a transparent thermosensitive recording medium capable of producing two different color images can be fabricated by successively providing a thermosensitive recording layer and a protective layer on each side of a transparent support, with each thermosensitive recording layer being capable of producing a different color.

Examples of the organic solvent in which the binder resin is dissolved include ethers such as dibutylether, isopropylether, dioxane, and tetrahydrofuran; ketones such as acetone, diethyl ketone methylethyl ketone, methylisobutyl ketone, and methylpropyl ketone; esters such as ethyl acetate, isopropyl acetate, n-propyl acetate, and n-butyl acetate; aromatic hydrocarbons such as benzene, toluene, and xylene. These solvents can be used alone or in combination.

There are no particular limitations on the method of providing the protective layer on the thermosensitive recording layer, or on the coated amount thereof. However, in view of the required performance of the protective layer and the cost for the provision of the protective layer, it is preferable that the coated thickness of the protective layer be in the range of 0.1 to 20 μm, more preferably in the range of 0.5 to 10 μm.

As the means for forming images on the transparent thermosensitive recording medium of the present invention, for instance, a thermal pen, a thermal head, means for application of laser, and thermal etching means utilizing light can be employed, but there are no particular limitations on the means for forming images on the transparent thermosensitive recording medium of the present invention, although different image formation means may be employed depending upon the applications.

However, a thermal head and a thermal etching means using light such as visible light or white light including infrared light are preferable for use in practice.

A method for forming images on a transparent thermosensitive recording medium of the present invention which bears a thermosensitive recording layer on both sides of the transparent support will now be explained with reference to FIGS. 1 to 3.

This transparent thermosensitive recording medium comprises a transparent support 1, and a thermosensitive recording layer 2 which is provided on one side of the transparent support 1, and a protective layer 4 on the thermosensitive recording layer 2; and another thermosensitive recording layer 3 on the other side of the transparent support 1, and another protective layer 5 on the thermosensitive recording layer 3.

This transparent thermosensitive recording medium can be fabricated as follows:

Image formation Method (1) shown in FIG. 1:

[Step A]

A positive original 13 comprising a support 7 and images 6 comprising carbon black formed on the support 7 is superimposed on one side of the transparent thermosensitive recording medium on the side of the thermosensitive recording layer 2, and a flush light or a strong white light is applied by a lamp 8 to the transparent thermosensitive recording medium from the side opposite to the superimposed original 13 so as to generate heat in the carbon black portions in the images.

The thermosensitive recording layer 2 is subjected to partial thermoetching by the thus generated heat to form colored images 9.

[Step B]

Colored images 11 are formed on the thermosensitive recording layer 3 by the application of heat thereto through a thermal head 10.

Thus, two different colored images 9 and 11 are formed by the above-mentioned Step A and Step B.

Figure 2:
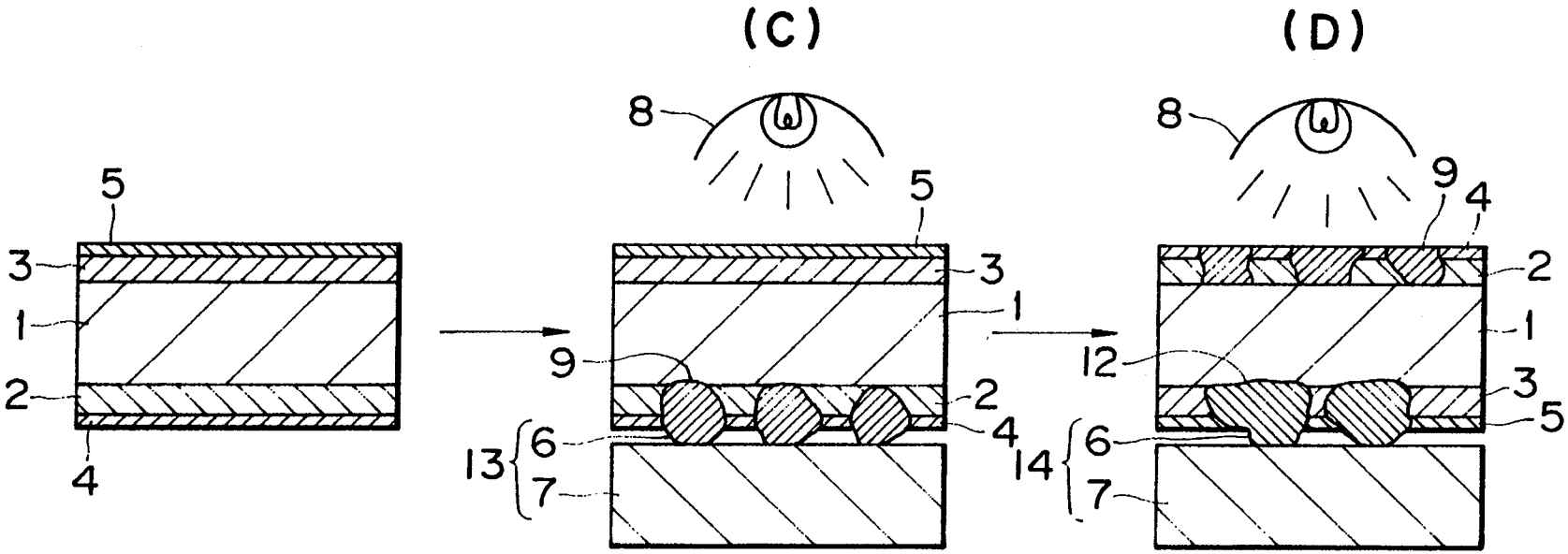
FIG. 2 is a schematic diagram for illustrating another method of forming two-colored images by use of a transparent thermosensitive recording medium of the present invention.

Image formation Method (2) shown in FIG. 2:

[Step C]

A positive original 13 comprising a support 7 and images 6 comprising carbon black formed on the support 7 is superimposed on one side of the transparent thermosensitive recording medium on the side of the thermosensitive recording layer 2, and a flush light or a strong white light is applied by a lamp 8 to the transparent thermosensitive recording medium from the side opposite to the superimposed original 13 so as to generate heat in the carbon black portions in the images.

The thermosensitive recording layer 2 is subjected to partial thermoetching by the thus generated heat to form colored images 9.

[Step D]

A negative image original 14 comprising a support 7 and images 6 comprising carbon black formed on the support 7 is superimposed on the other side of the transparent thermosensitive recording medium on the side of the thermosensitive recording layer 3 and colored images 12 are formed thereon in the same manner as in Step C.

Thus, two different colored images 9 and 12 are formed by the above-mentioned Step C and Step D.

Figure 3:
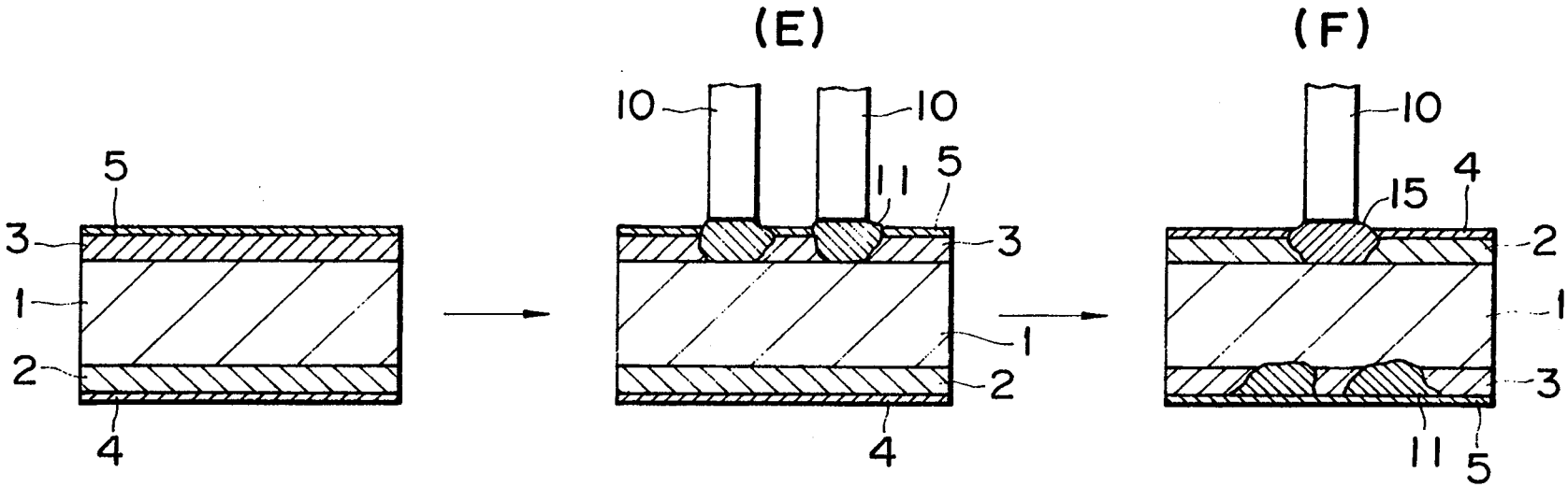
FIG. 3 is a schematic diagram for illustrating a further method of forming two-colored images by use of a transparent thermosensitive recording medium of the present invention.

Image formation Method (3) shown in FIG. 3:

[Step E]

Colored images 11 are formed on the thermosensitive recording layer 3 by the application of heat thereto by a thermal head 10.

[Step F]

Colored images 15 are formed on the thermosensitive recording layer 2 by the application of heat thereto through a thermal head 10.

Thus, two different colored images 11 and 15 are formed by the above-mentioned Step E and Step F.

The features of the present invention will become apparent in the course of the following description of exemplary embodiments, which are given for illustration of the invention and are not intended to be limiting thereof.

EXAMPLE 1

A mixture of the following components was placed together with stainless balls in a sample bottle and was dispersed in a desk top type ball mill for 48 hours, so that the average particle size of the octadecylphosphonic acid was made about 3 μm.

| | Parts by Weight |
|---|---|
| 3-(N-n-propyl-N-methylamino)-6-methyl-7-anilinofluoran | 10 |
| Octadecylphosphonic acid | 30 |
| Ethyl cellulose (made by Kanto Chemical Co., Inc.) refractive index: 1.47 | 15 |
| Toluene | 140 |
| Methyl ethyl ketone | 145 |

The thus prepared dispersion was coated on a surface-treated side of a one-side easy adhesion type transparent polyester film (Trademark "Teijin Tetron Film HPJ) with a thickness of 100 μm by a wire bar, with a coated thickness of 5.5 μm, and dried, whereby a transparent thermosensitive recording medium was prepared.

[Protective Layer Formation Liquid]

A mixture of the following components was sufficiently dispersed and pulverized in a ball mill, whereby a protective layer formation liquid was prepared:

| | Parts by Weight |
|---|---|
| Acryl emulsion (Trademark "Johncryl 390 made by S. C. Jonhson & Sons, Inc.) refractive index: 1.49 | 60 |
| 10% aqueous solution of epichlorohydrine/polyamide copolymer | 20 |
| Colloidal silica (10 mμm–50 mμm) | 2 |

The thus prepared protective layer formation liquid was coated on the thermosensitive recording layer with a thickness of 100 μm by a wire bar, with a coated thickness of 4.5 μm, and dried, whereby a transparent thermosensitive recording medium No. 1 of the present invention was prepared.

EXAMPLE 2

A mixture of the following components was placed together with stainless balls in a sample bottle and was dispersed in a desk top type ball mill for 48 hours, so that the average particle size of the octadecylphosphonic acid was made about 3 μm.

| | Parts by Weight |
|---|---|
| 3-diethylamino-6-methyl-7-anilinofluoran | 10 |
| Octadecylphosphonic acid | 30 |
| Polyvinyl butyral (Trademark "Denka Butyral #300-2 made by Denki Kagaku Kogyo Kabushiki kaisha) Refractive index: 1.49 | 15 |
| Toluene | 140 |
| Methyl ethyl ketone | 145 |

The thus prepared dispersion was coated on a surface-treated side of a one-side easy adhesion type transparent polyester film (Trademark "Teijin Tetron Film HPJ) with a thickness of 100 μm by a wire bar, with a coated thickness of 5.5 μm, and dried, whereby a transparent thermosensitive recording medium was prepared.

[Protective Layer Formation Liquid]

A mixture of the following components was sufficiently dispersed, whereby a protective layer formation liquid was prepared:

| | Parts by Weight |
|---|---|
| 75% butyl acetate solution of urethane acrylate ultraviolet curing resin (Trademark "Unidic C7-157 made by Dainippon Ink & Chemicals, Incorporated) refractive index: 1.56 | 100 |
| 52% xylene solution of silicone resin (Trademark "Byk-344 made by BYK-Chemie Japan K.K.) | 4.3 |
| Ethyl acetate | 50 |

The thus prepared protective layer formation liquid was coated on the thermosensitive recording layer by a wire bar, dried, and cured with an ultraviolet lamp of 80 W/cm, whereby a protective layer with a thickness of about 5 μm was formed on the thermosensitive recording layer.

Thus, a transparent thermosensitive recording medium No. 2 of the present invention was prepared.

EXAMPLE 3

A mixture of the following components was placed together with stainless balls in a sample bottle and was dispersed in a desk top type ball mill for 48 hours, so that the average particle size of stearyl gallate was made about 2 μm.

| | Parts by Weight |
|---|---|
| 3-diethylamino-6-methyl-7-(2',4'-dimethylanilino)fluoran | 10 |
| Stearyl gallate | 30 |
| Polyvinyl butyral (Trademark "S-Lec BX-1 made by Sekisui Chemical Co., Ltd.) refractive index: 1.48 | 15 |
| Toluene | 240 |
| Cyclohexane | 45 |

The thus prepared dispersion was coated on a duplex easy adhesion type transparent polyester film (Trademark "ICI Japan Merinex 705) with a thickness of 100 μm by a wire bar, with a coated thickness of 5.5 μm, and dried, whereby a transparent thermosensitive recording medium was prepared.

[Protective Layer Formation Liquid]

A mixture of the following components was sufficiently dispersed, whereby a protective layer formation liquid was prepared:

| | Parts by Weight |
|---|---|
| Polyphosphazene resin (Trademark "AC-101" made by Idemitsu petrochemical Co., Ltd.) refractive index: 1.59 | 100 |
| 50% xylene solution of silicone resin (Trademark "Byk-300 made by BYK-Chemie Japan KK) | 2 |

The thus prepared protective layer formation liquid was coated on the thermosensitive recording layer by a wire bar, dried, and cured with an ultraviolet lamp of 80 W/cm, whereby a protective layer with a thickness of about 5 μm was formed on the thermosensitive recording layer.

Thus, a transparent thermosensitive recording medium No. 3 of the present invention was prepared.

EXAMPLE 4

A mixture of the following components was placed together with stainless balls in a sample bottle and was dispersed in a desk top type ball mill for 48 hours, so that the average particle size of octadecylphosphonic acid was made about 3 μm.

| | Parts by Weight |
|---|---|
| 3-(N-iso-amyl-N-ethylamino)-7,8-benzfluoran | 10 |
| Octadecylphosphonic acid | 30 |
| Acryl resin (Trademark "Dianal BR-85" made by Mitsubishi Rayon Engineering Co., Ltd.) refractive index: 1.49 | 15 |
| 2-(2'-hydroxy-5'-methylphenyl) benzotriazole | 1 |
| 2,6-di-tert-butyl-4-methylphenol | 0.5 |
| Toluene | 140 |
| Methyl ethyl ketone | 145 |

The thus prepared dispersion was coated on a duplex easy adhesion type transparent polyester film (Trademark "ICI Japan Merinex 705) with a thickness of 100 μm by a wire bar, with a coated thickness of 5.5 μm, and dried, whereby a transparent thermosensitive recording medium was prepared.

[Protective Layer Formation Liquid]

A mixture of the following components was sufficiently dispersed, whereby a protective layer formation liquid was prepared:

| | Parts by Weight |
|---|---|
| 75% butyl acetate solution of urethane acrylate ultraviolet curing resin (Trademark "Unidic C7-157" made by Dainippon Ink & Chemicals, Incorporated) refractive index: 1.56 | 100 |
| Calcium carbonate (Trademark "Callight SA" made by Shiraishi | 1 |

-continued

| | Parts by Weight |
|---|---|
| Calcium Kaisha, Ltd.) | |
| Zinc stearate | 1 |
| Toluene | 50 |

The thus prepared protective layer formation liquid was coated on the thermosensitive recording layer by a wire bar, dried, and cured with an ultraviolet lamp of 80 W/cm, whereby a protective layer with a thickness of about 5 μm was formed on the thermosensitive recording layer.

Thus, a transparent thermosensitive recording medium No. 4 of the present invention was prepared.

EXAMPLE 5

A mixture of the following components was dispersed in a desk top type ball mill until the average particle size of octadecylphosphonic acid was made about 0.3 μm, without containing particles with particle sizes of 1 μm or more:

| | Parts by Weight |
|---|---|
| 3-diethylamino-6-methyl-7-anilinofluoran | 10 |
| Octadecylphosphonic acid | 30 |
| Polyvinyl butyral (Trademark "Denka Butyral #300-2 made by Denki Kagaku Kogyo Kabushiki kaisha) Refractive index: 1.49 | 15 |
| 2-(2'-hydroxy-3',5'-di-tert-butylphenyl)benzotriazole | 0.5 |
| 2,4,6-tri-tert-butylphenol | 0.5 |
| Mixed solvent of toluene/methyl ethyl ketone (1/1) | 285 |

The thus prepared dispersion was coated on a duplex destaticized transparent polyester film (Trademark "Teijin Tetron Film HMW) with a thickness of 100 μm by a wire bar, with a coated thickness of 5.0 μm, and dried, whereby a transparent thermosensitive recording medium was prepared.

[Protective Layer Formation Liquid]

A mixture of the following components was sufficiently dispersed, whereby a protective layer formation liquid was prepared:

| | Parts by Weight |
|---|---|
| 75% butyl acetate solution of urethane acrylate ultraviolet curing resin (Trademark "Unidic C7-157" made by Dainippon Ink & Chemicals, Incorporated) refractive index: 1.56 | 100 |
| 52% xylene solution of silicone resin (Trademark "Byk-344 made by BYK-Chemie Japan K.K.) | 4 |
| Ethyl acetate | 50 |

The thus prepared protective layer formation liquid was coated on the thermosensitive recording layer by a wire bar, dried, and cured with an ultraviolet lamp of 80 W/cm, whereby a protective layer with a thickness of about 3 μm was formed on the thermosensitive recording layer.

Thus, a transparent thermosensitive recording medium No. 5 of the present invention was prepared.

EXAMPLE 6

[Thermosensitive Recording Layer Formation Liquid A]

A mixture of the following components was dispersed in a ball mill until the average particle size of octadecylphosphonic acid was made about 0.3 μm, whereby a thermosensitive recording layer formation liquid A was prepared:

| | Parts by Weight |
|---|---|
| 3-diethylamino-6-methyl-7-anilinofluoran | 10 |
| Octadecylphosphonic acid | 30 |
| Polyvinyl butyral (Trademark "Denka Butyral #300-2 made by Denki Kagaku Kogyo Kabushiki kaisha) Refractive index: 1.49 | 15 |
| Mixed solvent of toluene/methyl ethyl ketone (1/1) | 285 |

[Thermosensitive Recording Layer Formation Liquid B]

A mixture of the following components was dispersed in a ball mill until the average particle size of octadecylphosphonic acid was made about 0.3 μm, whereby a thermosensitive recording layer formation liquid B was prepared:

| | Parts by Weight |
|---|---|
| 3-(N-iso-butyl-N-ethylamino)-7,8-benzfluoran | 10 |
| Octadecylphosphonic acid | 30 |
| Polyvinyl butyral (Trademark "Denka Butyral #300-2 made by Denki Kagaku Kogyo Kabushiki kaisha) Refractive index: 1.49 | 15 |
| Mixed solvent of toluene/methyl ethyl ketone (1/1) | 285 |

The thermosensitive recording layer formation liquid A was coated on a side A of a duplex adhesion-easy type transparent polyester film (Trademark "ICI Merinex") with a thickness of 100 μm by a wire bar, with a coated thickness of 5.5 μm, and dried, whereby a thermosensitive recording layer was provided on the side A of the polyester film.

The thermosensitive recording layer formation liquid B was then coated on a side B of the duplex adhesion-easy type transparent polyester film, opposite to the side A thereof, with a coated thickness of 5.5 μm, and dried, whereby a thermosensitive recording layer was formed on the side B.

[Protective Layer Formation Liquid]

A mixture of the following components was sufficiently dispersed, whereby a protective layer formation liquid was prepared:

| | Parts by Weight |
|---|---|
| 75% butyl acetate solution of urethane acrylate ultraviolet curing resin (Trademark "Unidic C7-157" made by Dainippon Ink & Chemicals, Incorporated) refractive index: 1.56 | 100 |
| 52% xylene solution of silicone resin (Trademark "Byk-344 made by BYK-Chemie | 4 |

-continued

| | Parts by Weight |
|---|---|
| Japan K.K.) | |
| Ethyl acetate | 50 |

The thus prepared protective layer formation liquid was coated on both of the thermosensitive recording layers by a wire bar, dried, and cured with an ultraviolet lamp of 80 W/cm, whereby a protective layer with a thickness of about 3 μm was formed on each of the thermosensitive recording layers.

Thus, a transparent thermosensitive recording medium No. 6 of the present invention, which was provided with the thermosensitive recording layer provided on both sides thereof, was prepared.

EXAMPLE 7

[Thermosensitive Recording Layer Formation Liquid A]

A mixture of the following components was dispersed in a ball mill until the average particle size of octadecylphosphonic acid was made about 0.3 μm, whereby a thermosensitive recording layer formation liquid A was prepared:

| | Parts by Weight |
|---|---|
| 3,6-bis(diethylamino)fluoran | 10 |
| Octadecylphosphonic acid | 30 |
| Polyvinyl butyral (Trademark "Denka Butyral #300-2 made by Denki Kagaku Kogyo Kabushiki kaisha) Refractive index: 1.49 | 15 |
| Mixed solvent of toluene/methyl ethyl ketone (1/1) | 285 |

[Thermosensitive Recording Layer Formation Liquid B]

A mixture of the following components was dispersed in a ball mill until the average particle size of eicosylphosphonic acid was made about 0.2 μm, whereby a thermosensitive recording layer formation liquid B was prepared:

| | Parts by Weight |
|---|---|
| 3-(N-iso-butyl-N-ethylamino)-7,8-benzfluoran | 10 |
| Eicosylphosphonic acid | 30 |
| Polyvinyl butyral (Trademark "Denka Butyral #300-2 made by Denki Kagaku Kogyo Kabushiki kaisha) Refractive index: 1.49 | 15 |
| Mixed solvent of toluene/methyl ethyl ketone (1/1) | 285 |

The thermosensitive recording layer formation liquid A was coated on a side A of a duplex adhesion-easy type transparent polyester film (Trademark "Teijin Tetron Film HMW") with a thickness of 100 μm by a wire bar, with a coated thickness of 5.5 μm, and dried, whereby a thermosensitive recording layer was provided on the side A of the polyester film.

The thermosensitive recording layer formation liquid B was then coated on a side B of the duplex adhesion-easy type transparent polyester film, opposite to the side A thereof, with a coated thickness of 5.5 μm, and dried, whereby a thermosensitive recording layer was formed on the side B.

[Protective Layer Formation Liquid]

A mixture of the following components was sufficiently dispersed, whereby a protective layer formation liquid was prepared:

| | Parts by Weight |
|---|---|
| 75% butyl acetate solution of urethane acrylate ultraviolet curing resin (Trademark "Unidic C7-157" made by Dainippon Ink & Chemicals, Incorporated) refractive index: 1.56 | 100 |
| 52% xylene solution of silicone resin (Trademark "Byk-344 made by BYK-Chemie Japan K.K.) | 3 |
| Ethyl acetate | 50 |

The thus prepared protective layer formation liquid was coated on both of the thermosensitive recording layers by a wire bar, dried, and cured with an ultraviolet lamp of 80 W/cm, whereby a protective layer with a thickness of about 3 μm was formed on each of the thermosensitive recording layers.

Thus, a transparent thermosensitive recording medium No. 7 of the present invention, which was provided with the thermosensitive recording layer provided on both sides thereof, was prepared.

Application Example 1

A positive image original prepared by a plain paper copier was superimposed on the side A of the transparent thermosensitive recording medium No. 6 of the present invention prepared in Example 6, and strong light was applied to the side B of the transparent thermosensitive recording medium No. 6 by use of 3M Transparency Maker (made by 3M), whereby black images were formed on the side A of the transparent thermosensitive recording medium No. 6.

Red positive images were formed on the side B of the transparent thermosensitive recording medium No. 6 by use of a thermal head of a commercially available thermal transfer printer (Trademark "NL-1 Printer" made by Ricoh Co., Ltd.).

Thus, two colored images (i.e., black images and red images) were formed on the transparent thermosensitive recording medium No. 6.

Application Example 2

A positive image original prepared by a plain paper copier was superimposed on the side A of the transparent thermosensitive recording medium No. 7 of the present invention prepared in Example 7, and strong light was applied to the side B of the transparent thermosensitive recording medium B by use of 3M Transparency Maker (made by 3M), whereby blue images were formed on the side A of the transparent thermosensitive recording medium No. 7.

A negative image original prepared by a plain paper copier was superimposed on the side B of the transparent thermosensitive recording medium No. 7 and strong light was applied to the side A of the transparent thermosensitive recording medium No. 7 by use of 3M Transparency Maker (made by 3M), whereby red images were formed on the side B of the transparent thermosensitive recording medium No. 7.

Thus, two colored images (i.e., blue images and red images) were formed on the transparent thermosensitive recording medium No. 7.

Application Example 3

Black positive images were formed on the side A of the transparent thermosensitive recording medium No. 6 prepared in Example 6 by use of a thermal head of a commercially available thermal transfer printer (Trademark "NL-1Printer" made by Ricoh Co., Ltd.).

Then red negative images were formed on the side B of the transparent thermosensitive recording medium No. 6 by use of the same thermal head of the commercially available thermal transfer printer as mentioned above.

Thus, two colored images (i.e., black images and red images) were formed on the transparent thermosensitive recording medium No. 6.

Comparative Example 1

The procedure for preparing the transparent thermosensitive recording medium No. 1 in Example 1 was repeated except that the formation of the protective layer was omitted, whereby a comparative transparent thermosensitive recording medium No. 1 was prepared.

Comparative Example 2

The procedure for preparing the transparent thermosensitive recording medium No. 2 in Example 2 was repeated except that the urethane acrylate ultraviolet curing resin employed in the protective layer of the recording medium No. 2 was replaced by polysulfone resin, whereby a comparative transparent thermosensitive recording medium No. 2 was prepared.

The thus prepared transparent thermosensitive recording media No. 1 to No. 5 prepared in Examples 1 to 5, and the comparative transparent thermosensitive recording media No. 1 and No. 2 were subjected to image formation tests by use of a printing apparatus provided with a 8 dots/mm thermal head with the application of a printing energy with a power of 1.0 W and a pulse width of 0.9 msec, and the formed images were evaluated with respect to the following evaluation items:

(1) Developed color tone:

The color tone of printed images was visually inspected immediately after the recording thereof.

(2) Transmission Density:

The image density and background density of images were measured immediately after the recording of the images by use of a transmission type densitometer X-Rite 310TR made by XRITE Company, Ltd.

(3) Transparency:

The transparency of each transparent thermosensitive recording medium was determined by measuring the illuminance by actually projecting light therethrough by a commercially available reflection type overhead projector (Trademark "OHP312R" made by Ricoh Co., Ltd.). For comparison, the illuminance of the light which passed through a commercially available transparent PET film with a thickness of 100 μm (Trademark "Lumirror Type T" made by Toray Industries, Inc.) was measured 489 lux.

The transparency of each transparent thermosensitive recording medium was also evaluated in terms of spectral transmittance with a spectral wavelength of 570 nm by use of a commercially available spectrometer (Trademark "UV-3100" made by Shimadzu Corporation).

(4) Preservability:

4-1 Heat resistance

Each transparent thermosensitive recording medium was preserved in a dry state at 40° C. for 24 hours, so that the densities of an image area and a background area were measured.

4-2 Light resistance

Each transparent thermosensitive recording medium was exposed to light with an illuminance of 5000 lux of a fluorescent lamp for 120 hours, so that the densities of an image area and a background area were measured.

(5) Resistance to chemicals:

Ethyl alcohol was kept in contact with the surface of each transparent thermosensitive recording medium at room temperature (24° C.) for 15 minutes, and the stability of each transparent thermosensitive recording medium was visually inspected and evaluated.

(6) Running performance:

The running performance (i.e., head-matching performance) of each transparent thermosensitive recording medium was evaluated by subjecting each recording medium to a printing test by use of the previously mentioned printing apparatus.

The results are shown in the following Table 1. In the evaluation of the resistance to chemicals and the running performance, mark "o" denotes "excellent", mark "Δ" denotes "good", and mark "X" denotes "no good or inferior".

TABLE 1

| | Evaluation Item | | | | | | | | | | |
|---|---|---|---|---|---|---|---|---|---|---|---|
| | | Transmission Density | | Transparency | | Preservability | | | | | |
| | | | | OHP | Spectral | Heat Resistance | | Light Resistance | | Resistance | |
| | Developed Color | Image | Back-ground | Illuminance (Lux) | Transmittance (%) | Image | Back-ground | Image | Back-ground | to Chemicals | Running Performance |
| Ex. 1 | black | 0.98 | 0.06 | 370 | 68 | 0.97 | 0.05 | 0.95 | 0.06 | Δ | Δ |
| Ex. 2 | black | 1.00 | 0.05 | 460 | 82 | 1.00 | 0.05 | 0.97 | 0.06 | ○ | ○ |
| Ex. 3 | black | 0.82 | 0.09 | 348 | 62 | 0.80 | 0.09 | 0.81 | 0.09 | ○ | ○ |
| Ex. 4 | red | 1.68 | 0.08 | 484 | 84 | 1.12 | 0.04 | 1.36 | 0.05 | ○ | ○ |
| Ex. 5 | black | 1.58 | 0.06 | 462 | 82 | 1.58 | 0.06 | 1.55 | 0.07 | ○ | ○ |
| Comp. Ex. 1 | black | 0.96 | 0.05 | 120 | 30 | 0.95 | 0.05 | 0.94 | 0.06 | X | X |
| Comp. Ex. 2 | black | 0.90 | 0.08 | 229 | 47 | 0.82 | 0.08 | 0.88 | 0.10 | ○ | Δ |

What is claimed is:

1. A transparent thermosensitive recording medium comprising:

a transparent support, a thermosensitive recording layer which comprises an electron-donating coloring compound, an electron-accepting compound and a binder resin, formed on said transparent support, and a protective layer formed on said thermosensitive recording layer, with said transparent support, said thermosensitive recording layers and said protective layer having substantially the same refractive index.

2. The transparent thermosensitive recording medium as claimed in claim 1, wherein the refractive index of said binder resin contained in said thermosensitive recording layer is in the range of 1.45 to 1.60.

3. The transparent thermosensitive recording medium as claimed in claim 1, wherein said electron-accepting compound contained in said thermosensitive recording layer is an organic phosphoric acid compound, and said binder resin contained in said thermosensitive recording layer is a binder resin including a hydroxyl group in the molecule thereof.

4. The transparent thermosensitive recording medium as claimed in claim 3, wherein said electron-accepting compound contained in said thermosensitive recording layer is an organic phosphoric acid compound of formula (I) or formula (II):

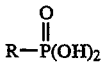

(I)

wherein R is a straight-chain alkyl group having 16 to 24 carbon atoms; and

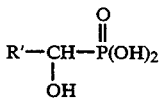

(II)

wherein R′ is a straight-chain alkyl group having 13 to 23 carbon atoms.

5. A transparent thermosensitive recording medium comprising:

a transparent support, a first thermosensitive recording layer comprising an electron-donating compound, an electron-accepting compound and a binder resin, which is capable of producing a first color, a protective layer, said first thermosensitive recording layer and said protective layer being successively formed on one side of said transparent support, a second thermosensitive recording layer comprising an electron-donating compound, an electron-accepting compound and a binder resin, which is capable of producing a second color, a protective layer, said second thermosensitive recording layer and said protective layer being successively formed on the other side of said transparent support, with the refractive index of each of said first and second thermosensitive recording layers and said protective layer being substantially the same as the refractive index of said transparent support.

6. The transparent thermosensitive recording medium as claimed in claim 5, wherein said first color produced by said first thermosensitive recording layer is different from said second color produced by said second thermosensitive recording layer.

* * * * *

UNITED STATES PATENT AND TRADEMARK OFFICE

CERTIFICATE OF CORRECTION

PATENT NO. : 5,380,693

DATED : Jan. 10, 1995

INVENTOR(S) : Hiroshi Goto

It is certified that error appears in the above-indentified patent and that said Letters Patent is hereby corrected as shown below:

COLUMN 3, line 16, "Specific example" should read --Specific examples--.

COLUMN 7, line 44, "HEA/TDI/HDO/ADA/HDO/TDI/HEA" should read --(d) HEA/TDI/HDO/ADA/HDO/TDI/HEA--.

COLUMN 8, line 43 of the structure, "(polybutadien)" should read --(polybutadiene)--.

Signed and Sealed this

Eighteenth Day of June, 1996

Bruce Lehman

*Attest:*

BRUCE LEHMAN

*Attesting Officer*

*Commissioner of Patents and Trademarks*